US005224647A

United States Patent [19]

Yanow

[11] Patent Number: 5,224,647

[45] Date of Patent: Jul. 6, 1993

[54] REMAILABLE ENVELOPE

[75] Inventor: Joel Yanow, Montreal, Canada

[73] Assignee: Supremex Inc., Montreal, Canada

[21] Appl. No.: 928,100

[22] Filed: Aug. 13, 1992

Related U.S. Application Data

[63] Continuation of Ser. No. 703,855, May 21, 1991.

[51] Int. Cl.[5] ..... B65D 27/06

[52] U.S. Cl. ..... 229/302; 229/303; 229/306

[58] Field of Search ..... 229/71, 301, 302, 303, 229/306

[56] References Cited

U.S. PATENT DOCUMENTS

| | | | |
|---|---|---|---|
| 1,205,543 | 11/1916 | Hopke et al. | 229/71 X |
| 1,575,769 | 3/1926 | Kaye | 229/73 |
| 2,681,175 | 6/1954 | David | 229/71 X |
| 3,084,846 | 4/1963 | Clegg | 229/73 |
| 3,558,040 | 1/1971 | Krueger | 229/73 |
| 3,693,869 | 9/1972 | Eaves, Jr. | 229/71 X |
| 4,194,631 | 3/1980 | Rangan | 229/73 X |
| 4,288,028 | 9/1981 | Diaz | 229/73 |
| 4,308,987 | 1/1982 | Solomon | 229/73 |
| 4,332,346 | 6/1982 | Kronman | 229/73 |
| 4,382,539 | 5/1983 | Kronman | 229/73 |
| 4,445,635 | 5/1984 | Barr | 229/302 |
| 4,565,317 | 1/1986 | Kranz | 229/73 |
| 4,595,138 | 6/1986 | Kristel | 229/73 |
| 4,730,768 | 3/1988 | Gendron | 229/73 |

FOREIGN PATENT DOCUMENTS

| | | | |
|---|---|---|---|
| 2394460 | 2/1979 | France | 229/302 |

*Primary Examiner*—Allan N. Shoap
*Assistant Examiner*—Jes F. Pascua
*Attorney, Agent, or Firm*—Foley & Lardner

[57] ABSTRACT

A remailable envelope having a first closure flap hinged to the front panel and being separable from the front panel. A remailable panel is hinged to the rear panel and can overlap the front panel to the full extent thereof, and a second closure flap is hinged to the remailable panel. The remailable panel extends over the front panel, and the second closure flap folds over the bottom edge of the envelope to be sealed to the rear panel. Remailing intelligence is provided on the remailable panel which itself covers the first addressee's information on the front panel and any bar codes which might appear on the front or rear panels.

8 Claims, 3 Drawing Sheets

REMAILABLE ENVELOPE

This application is a continuation of application Ser. No. 07/703,855, filed May 21, 1991.

BACKGROUND OF THE INVENTION

1. Field of the Invention

The present invention relates to envelopes, and more particularly, to remailable envelopes.

2. Description of the Prior Art

Although there are several remailable or two-way envelopes which have been developed over the years, it still remains that the vast majority of companies which send out mass mailings of billing statements every month to consumer clients still use a standard window one-way mailing envelope with a separate return envelope stuffed inside. There is a definite need to come up with an acceptable two-way envelope to replace the relatively expensive and ecologically wasteful practice of using two separate envelopes.

One type of proposed remailable envelope described in the prior art includes a standard envelope which has a front and back panel, a sealable closure flap separably connected to the front panel and a sealable flap connected to the rear panel. When the supplier, i.e., gas or telephone company, sends out its monthly statement, the flap on the rear panel is folded into the envelope, and the closure flap connected to the front panel overlies the rear panel and is sealed thereto. The consumer, when returning his payment, tears off the closure flap attached to the front panel and uses the flap connected to the rear panel to overlie the front panel. The return address would be preprinted on this latter flap. The flap could be made large enough to overlie any bar code on the front panel.

Examples of such envelopes are described in U.S. Pat. Nos. 3,558,040, Krueger, 1971; 4,308,987, Solomon, 1982; 4,565,317, Kranz, 1986; 4,595,138, Kristel, 1986; and 4,730,768, Gendron, 1988; and Canadian Patent 901,533, MacDougall, 1972.

However, such two-way envelopes having the mailing address printed on the closure flap overlying the front panel would not be acceptable by some postal authorities, including, for instance, Canada Post. According to Canada Postal Guide Part I (2.3), it is stated that the "addresses on envelopes must appear on the plain side (never on the side with the closing flap)".

It is also becoming common to find bar codes, which are readable by the post office distribution equipment, on both the front and rear panels making it impossible to use the same envelope for return mailing as proposed in the above patents, since the bar code on the rear panel would still be exposed.

SUMMARY OF THE INVENTION

It is an aim of the present invention to provide a remailable envelope which is of simple construction, thereby capable of being fabricated and stuffed by automatic equipment.

It is a further aim of the present invention to provide a remailable envelope which will meet the above-mentioned guidelines and which will obliterate the bar codes printed thereon at the first mailing.

A remailable envelope in accordance with the present invention comprises a front panel and a rear panel coextensive with the front panel and having a common bottom edge therewith, and means joining the front and rear panels along the side edges to form the envelope body. A first closure flap is foldable about a first fold line at the top edge of the front panel, such that the first closure flap can be sealed to the rear panel for mailing with the addressee intelligence provided on the front panel. The first closure flap is separable from the front panel strippable from the rear panel. A remailing panel is folded along a second fold line at the top edge of the rear panel and is adapted to overlie the front panel when the envelope is remailed and is stuffed in the body of the envelope on the first mailing. A second closure flap is foldably connected to the remailing panel along an opposite edge, parallel to the second fold line and is foldable over the bottom edge of the envelope body to be sealed on the rear panel when the remailing panel overlies the front panel in the remailing mode and the remailing addressee intelligence is provided on the remailing panel.

In another aspect of the present invention, there is provided a blank for forming a remailing envelope, including a first panel having parallel longitudinal first and second fold lines and a second panel connected to the second fold line and a first closure flap connected to the first fold line. The second panel includes a third fold line along a longitudinal edge thereof which is parallel with the second fold line common to the first and second panels, and a third panel is connected along the third fold line to the second panel and is foldable thereabout. The third panel has a fourth fold line along which a second closure flap is connected and is foldable thereabout.

In a more specific embodiment of the blank, a pair of side flaps are provided along the end edges of the first panel and are foldable inwardly over the end edges to be joined to the second panel to form the envelope body.

In a still more specific embodiment of the blank of the present invention, there is provided a fold line intermediate the third panel to allow the third panel to be folded on itself for stuffing within the envelope body.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 3A:
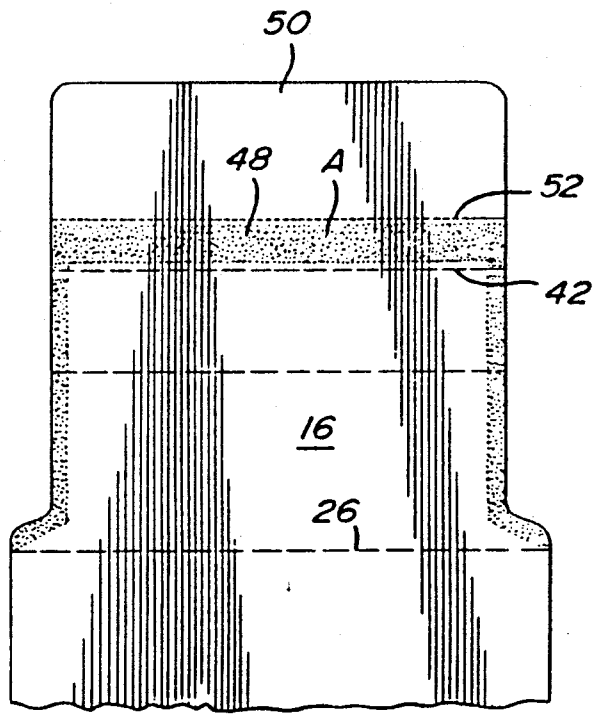
FIG. 3*a* is a fragmentary plan view of a blank showing a further embodiment of the blank shown in FIG. 3.
Figure 3:
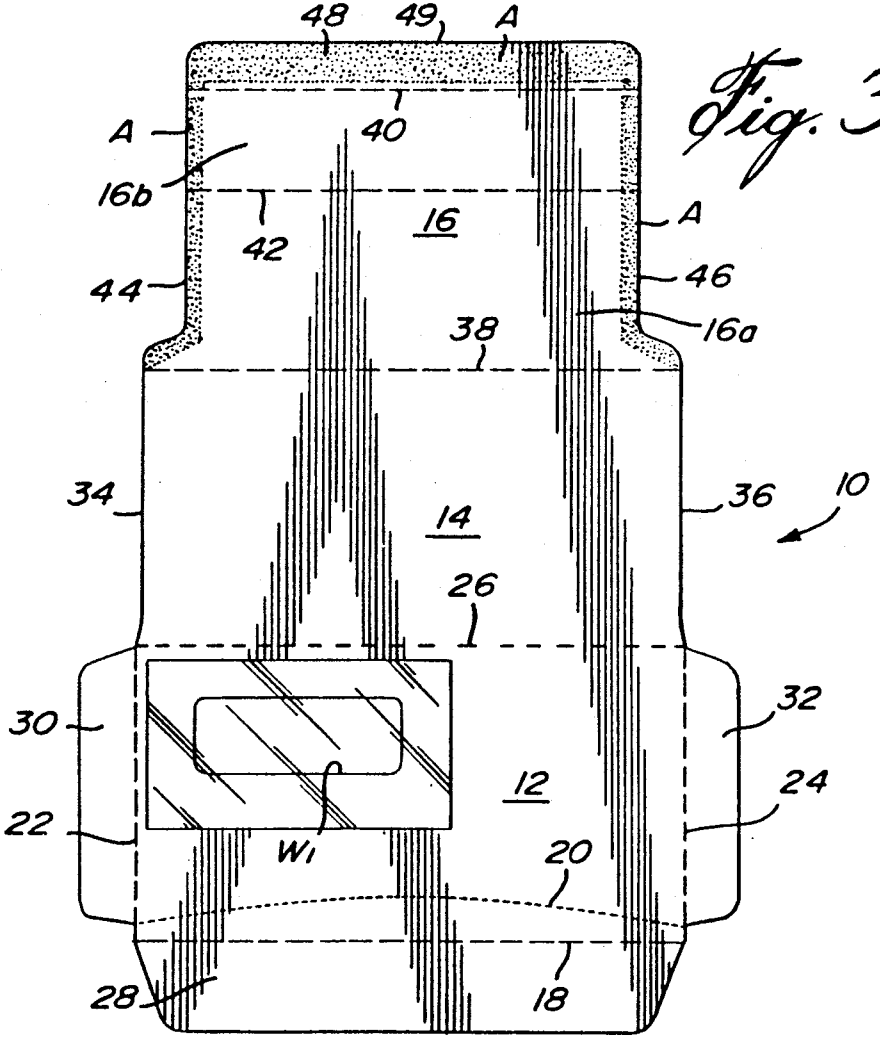
FIG. 3 is a plan view of a blank in accordance with the present invention.

Referring now to the drawings, there is shown in FIG. 3 a blank for forming the remailable envelope 10. The blank includes a first panel 12 which will serve as the front panel and a panel 14 which serves as the rear panel. A panel 16 is also provided which is the remailing panel.

Panel 12 includes fold lines 18, 22, 24, and 26. A closure flap 28 is connected to and folds about fold line 18 while side closure flaps 30 and 32 fold about fold lines 22 and 24 respectively. A perforated line 20 is provided in the panel 12 at a short distance from the fold line 18 for purposes as will be described further on. A tear strip could replace the perforated line 20. A window W1 is located in the front panel 12 as a means to show through the addressee intelligence on a document, such as a statement which would be enclosed in the envelope body.

The rear panel 14 has side edges 34 and 36. The longitudinal dimension of the panel 14, that is, between edges 34 and 36, is slightly less than the longitudinal dimensions between the fold lines 22 and 24 of panel 12 so as to allow the panel 14 to fit within the dimensions of the panel 12 to allow the side flaps 30 and 32 to fold thereover. Of course, adhesive A would be provided on flaps 30 and 32 to be joined to the rear panel 14. The flaps 30 and 32 can either be sealed to the inner surface of the panel 14 or the outer surface thereof.

Panel 16 folds over fold line 38. The panel 16 can, for convenience of stuffing within the envelope body, be folded along fold line 42 just parallel to the fold line 38 and to be temporarily folded into two sub-panels 16*a* and 16*b*. The edges 44 and 46 of the panel 16 have a longitudinal dimension which is less than both panels 14 and 12 in order to allow the panel 16 to be easily stuffed into the envelope body when the envelope is assembled.

A closure flap 48 is provided to fold along fold line 40 on the other edge of the panel 16 and is provided with an end edge 49. The sum of the lateral dimensions of sub-panel 16*b* and 48 or the distance between fold line 42 and edge 49 is approximately equal to the lateral dimension of panel 16*a* or the distance between fold line 38 and fold line 42 in order to avoid folding the flap 48 during stuffing.

The lateral dimension, that is, between fold lines 38 and 40 of panel 16, is greater than the lateral dimension of the panel 12 from the perforated line 20 to the fold line 26 to allow the panel 16 to completely overlie the front face of panel 12 when assembled for remailing.

Another embodiment of the blank is shown in FIG. 3*a* where an accessory flap 50 could be provided along perforated line 52 at the end of the closure flap 48. This accessory flap 50 could be a change of address form, meter information form, etc.

Figure 1:
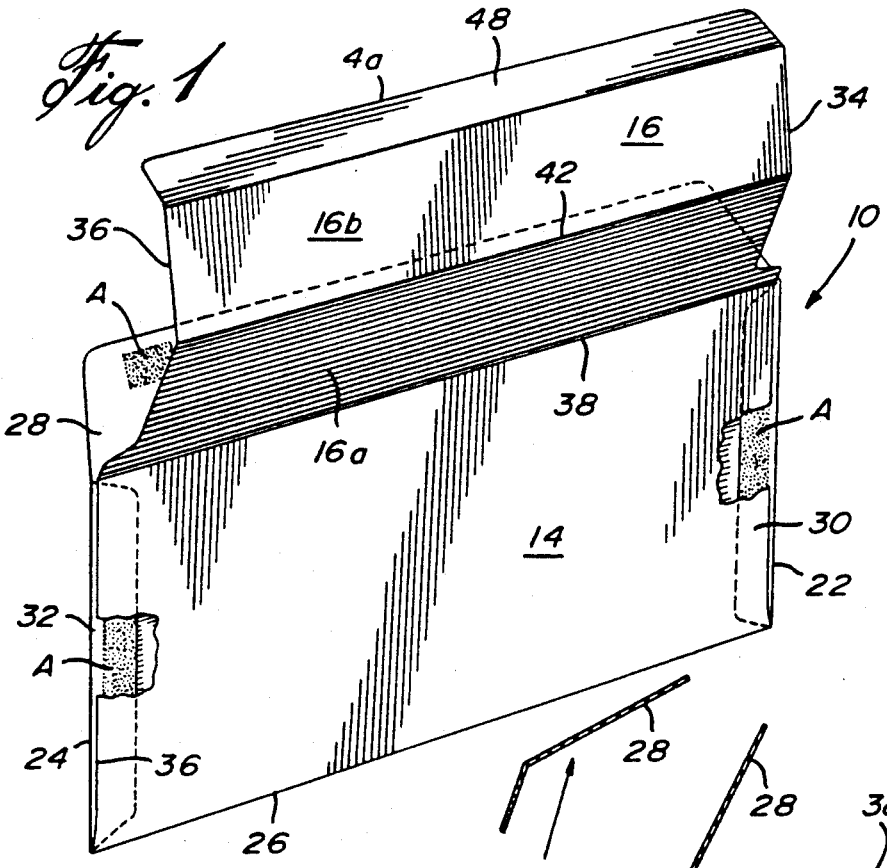
FIG. 1 is a perspective view of an envelope in accordance with the present invention, in one stage of the operation.
Figure 2:
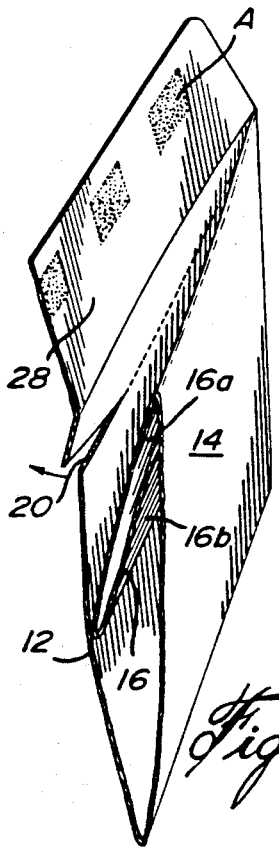
FIG. 2 is a fragmentary perspective view of the envelope in another operative stage.
Figure 4:
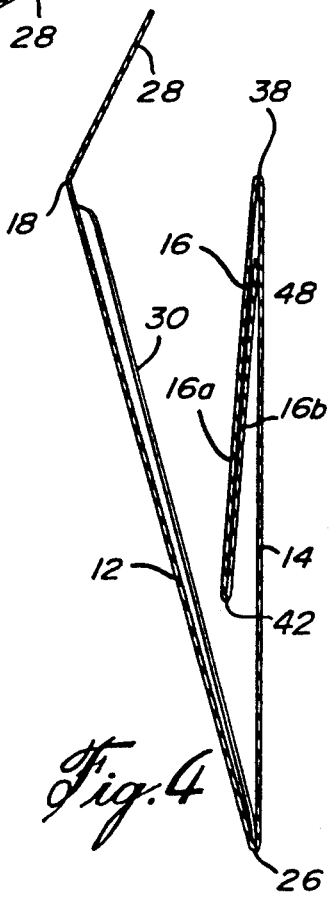
FIG. 4 is a cross-sectional view of a blank being folded to be assembled into a remailing envelope.

FIGS. 1, 2, and 4 show the envelope in its condition for a first mailing. Thus, the rear panel 14 is folded against a front panel along fold line 26 and, as previously discussed, the flaps 30 and 32 having adhesive A joined against the rear panel 14. As shown in FIGS. 1, 2, and 4, panels 16 and 48 are folded over into sub-panels 16*a* and 16*b* and is stuffed into the body of the envelope so formed as shown particularly in FIG. 4. The closure flap 28, once the statement is placed in the body of the envelope with the addressee intelligence shown through window W1, will be closed over on the rear panel 14, and adhesive A would secure the flap 28 to the rear panel 14.

Figure 6:
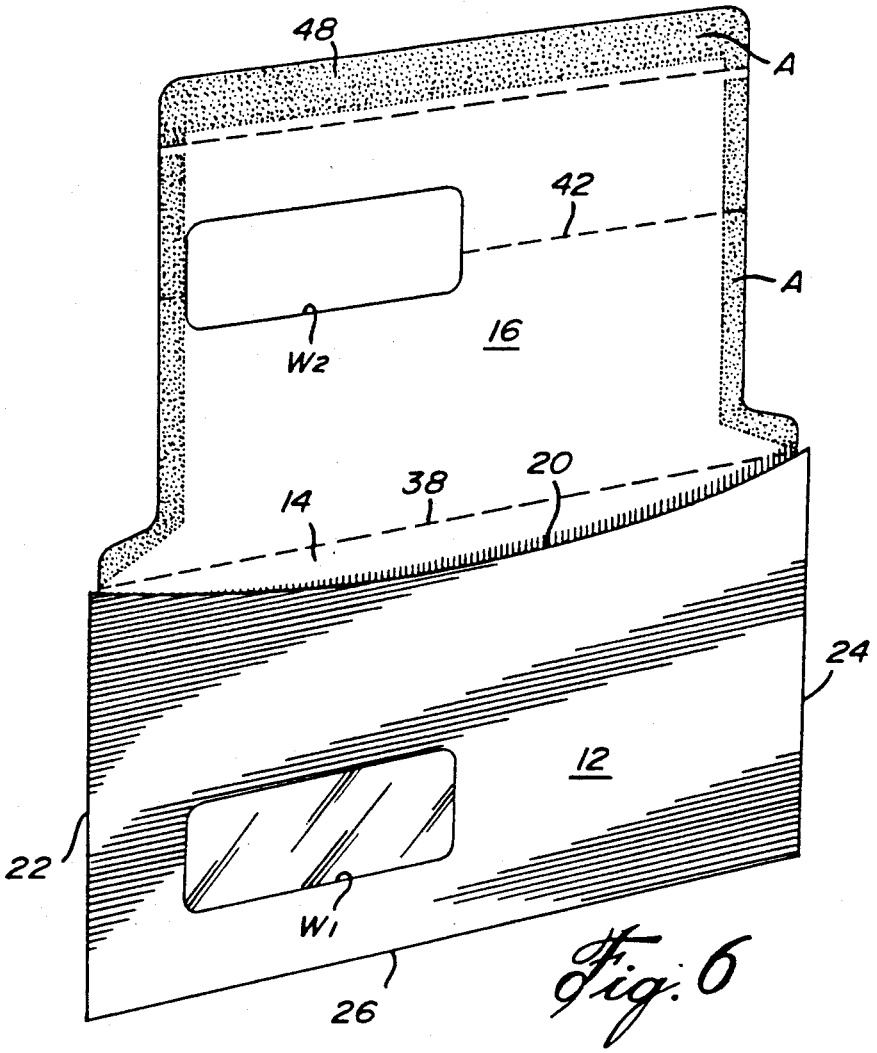
FIG. 6 is a perspective view of a different envelope being prepared for remailing.
Figure 7:
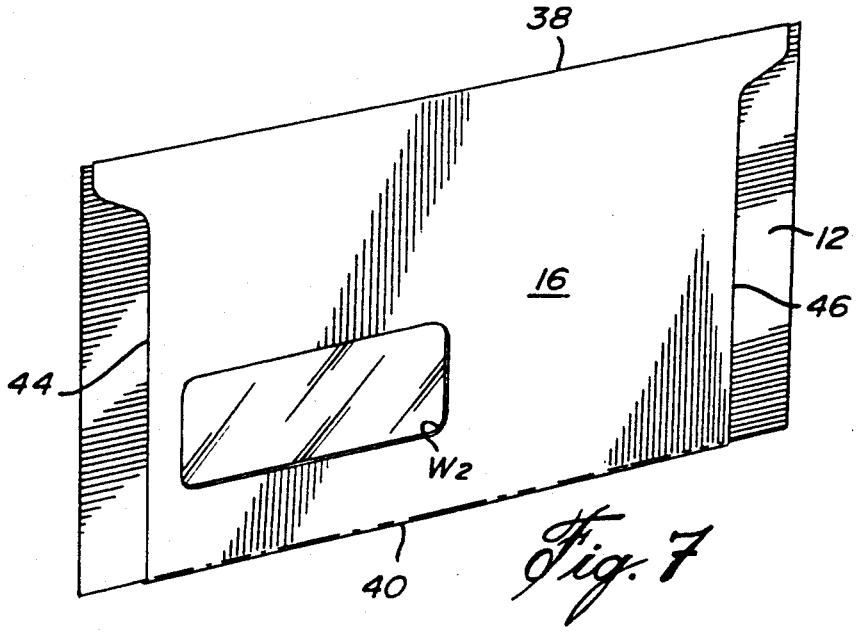
FIG. 7 is a perspective view of the envelope in accordance with the embodiment of FIG. 6, closed and sealed for remailing.

When the recipient receives the envelope 10, the closure flap 28 can be removed by tearing it along perforated lines 20 and by lifting the sealed portion from the rear panel 14. The adhesive A on the flap 28 may be a releasable adhesive which would avoid damaging the rear panel 14 when the closure flap is being removed. On the other hand, a split glue pattern may be preferable to detect tampering. In any event, the flap 16 is unfolded from the envelope body, and once the recipient's cheque or return information is placed into the body of the envelope, the panel 16 is then folded over the front panel 12 somewhat as shown in FIGS. 6 and 7.

A window W2 can either be provided in the flap 16 or the return addressee intelligence would be printed on the face of the panel 16.

Figure 5:
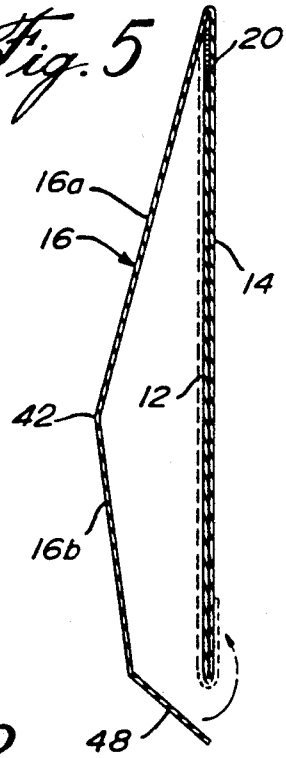
FIG. 5 is a cross-sectional view, similar to FIG. 4, showing a further stage of the envelope being converted to be remailed.

The closure flap 48 is folded around the edge 26 to be adhered to the rear panel 14 along the bottom thereof somewhat as shown in FIG. 5. Panel 16 which overlies the front panel covers any bar code and also meets the guidelines produced, for instance, by Canada Post as mentioned above. At the same time, the closure flap 48 is coextensive with panel 16 and is on the rear of the envelope and covers any bar codes which might be provided on the rear panel at the bottom thereof.

The envelope can be modified in several ways. For instance, the side flaps 30 and 32 can be eliminated, and the edge portions of the panels 12 and 14 could be glued together. Windows W1 and W2 can be completely eliminated. Adhesive A may be provided along the edges 44 and 46 of panel 16 so as to close the panel 16 against the front panel 12 in the remailing mode. The edges 44 and 46 can be asymmetrical in order to ensure complete covering of any information or bar code or stamps which might appear on the front face.

Thus, the envelope can be used as a two-way envelope and is of simple construction.

I claim:

1. A remailable envelope comprising a front panel having predetermined longitudinal and lateral dimensions and a rear panel co-extensive with the front panel while having a common first edge therewith, means joining the front and rear panels along side edges thereof to form the envelope body, a first closure flap foldable about a first fold line at a second edge of the front panel such that the first closure flap can be sealed to the rear panel for first mailing with the addressee intelligence readable at the front panel, means for separating said first closure flap from the front panel while removing a portion of the front panel to reduce the lateral dimension thereof, a remailing panel integral with and folded along a second fold line at the second edge of the rear panel, the remailing panel having an overall longitudinal dimension which is less than the longitudinal dimension of the front panel to provide for the stuffing of the remailing panel into the envelope during first mailing but great enough to cover all of the intelligence on the front panel during remailing and having a lateral dimension greater than the reduced lateral dimension of the front panel to allow the remailing panel to overlie the front panel when the envelope is remailed; a second flap integral and substantially co-extensive over the longitudinal dimension of the remailing panel and foldable along a third fold line at the opposite edge of the remailing panel parallel to the second fold line, the second closure flap being foldable over the first edge of the envelope body to be sealed on the rear panel when the remailing panel overlies the front panel whereby the second flap substantially covers the lower part of the rear panel to ensure obliteration of any mailing codes thereon, and wherein the remailing addressee intelligence is readable on the remailing panel.

2. A remailable envelope as defined in claim 1, wherein the means for separating the first closure flap includes a perforated line provided on the front panel spaced from the second edge thereof so that when the first closure flap is separated from the front panel, the lateral dimension of the front panel is less than the corresponding dimension of the remailing panel when it is folded thereover to overlie the front panel.

3. A remailable envelope as defined in claim 1, wherein the front panel has a window defined therein to see the addressee intelligence on the contents of the material within the body of the envelope.

4. A remailable envelope as defined in claim 3, wherein a window opening is provided in the remailing panel which, when folded over the front panel, is coincident with the window in the front panel.

5. A remailable envelope as defined in claim 1, wherein a fold line is provided intermediate the remailing panel to form a first and second sub-panel so that the first sub-panel is folded on the second sub-panel for stuffing within the envelope body, said fold line being located such that the lateral dimension of the second sub-panel and the second closure flap is equal to the lateral dimension of the first sub-panel.

6. A remailable envelope as defined in claim 1, wherein a first adhesive means is provided on the first closure flap to seal said first closure flap to the rear panel, second adhesive means is provided on the second closure flap for sealing said second closure flap to the rear panel, and third adhesive means is provided along side edges of the remailing panel to seal the remailing panel to the front panel.

7. A remailable envelope as defined in claim 1 wherein the second flap is provided with an end edge which is parallel with the third full line and an accessory panel is attached to the second flap at the end edge thereof, by means of a tear line.

8. A remailable envelope comprising a front panel and a rear panel co-extensive with the front panel and having a common first edge therewith, means joining the front and rear panels along side edges thereof to form the envelope body, a first closure flap foldable about a first fold line at a second edge of the front panel such that the first closure flap can be sealed to the rear panel for first mailing, the front panel having a window defined therein to see the addressee intelligence on the contents of the material within the body of the envelope, said first closure flap being separable from the front panel for remailing, and a remailing panel integral with and folded along a second fold line at the second edge of the rear panel and adapted to overlie the front panel when the envelope is remailed and adapted to be stuffed into the body of the envelope at the first mailing, said remailing panel being provided with a window opening coincident with the window in the front panel when the remailing panel overlies the front panel, a second closure flap integral with the remailing panel and foldable along an opposite edge of the remailing panel parallel to the second fold line, the second closure flap being foldable over the first edge of the envelope body to be sealed on the rear panel when the remailing panel overlies the front panel.

* * * * *